US005809863A

United States Patent [19]

Tominaga et al.

[11] Patent Number: 5,809,863

[45] Date of Patent: Sep. 22, 1998

[54] SWASH PLATE TYPE AXIAL PISTON PUMP

[75] Inventors: Tsutomu Tominaga; Kazuyoshi Yamamoto; Osamu Matsumoto; Mitsuharu Hashiba, all of Tokyo, Japan

[73] Assignee: Mitsubishi Denki Kabushiki Kaisha, Tokyo, Japan

[21] Appl. No.: 626,374

[22] Filed: Apr. 2, 1996

[30] Foreign Application Priority Data

Oct. 24, 1995 [JP] Japan ..... 7-275887

[51] Int. Cl.[6] ..... F01B 13/04; F04B 1/20

[52] U.S. Cl. ..... 92/57; 92/71; 417/269

[58] Field of Search ..... 417/269, DIG. 1, 417/219–222.2; 91/499–507; 92/57, 71

[56] References Cited

U.S. PATENT DOCUMENTS

| | | | |
|---|---|---|---|
| 4,007,663 | 2/1977 | Nagatomo et al. | 417/269 |
| 4,037,522 | 7/1977 | Inoshita et al. | 92/71 |
| 4,204,406 | 5/1980 | Hopfe | 417/331 |
| 4,268,225 | 5/1981 | Nakayama et al. | 417/269 |
| 4,285,640 | 8/1981 | Mukai | 417/269 |
| 4,309,115 | 1/1982 | Klein et al. | 366/79 |
| 4,568,252 | 2/1986 | Hattori et al. | 92/71 |
| 4,611,529 | 9/1986 | Stricker et al. | 417/269 |
| 4,617,856 | 10/1986 | Miller et al. | 417/269 |
| 4,644,850 | 2/1987 | Kanamaru et al. | 417/269 |
| 4,683,803 | 8/1987 | Miller et al. | 417/269 |
| 5,176,066 | 1/1993 | Kanamaru et al. | 417/269 |
| 5,178,643 | 1/1993 | Schimweg | 51/293 |
| 5,391,058 | 2/1995 | Goto et al. | 417/269 |
| 5,468,130 | 11/1995 | Yamada et al. | 418/55.2 |
| 5,540,139 | 7/1996 | Martensen et al. | 92/57 |
| 5,578,887 | 11/1996 | Shirasaki | 310/323 |
| 5,588,347 | 12/1996 | Jepsen | 92/57 |
| 5,601,009 | 2/1997 | Jepsen et al. | 92/71 |
| 5,622,097 | 4/1997 | Martensen et al. | 92/57 |
| 5,671,653 | 9/1997 | Martensen et al. | 92/57 |

FOREIGN PATENT DOCUMENTS

| | | |
|---|---|---|
| 0616128 | 9/1994 | European Pat. Off. . |
| 2521182 | 11/1976 | Germany . |
| 2917771 | 6/1979 | Germany . |
| 6280740 | 10/1994 | Japan . |
| 2368578 | 5/1991 | United Kingdom . |

OTHER PUBLICATIONS

Patent Abstracts of Japan, M–1209. Feb. 10, 1992. vol. 16/No. 51.

Patent Abstracts of Japan. M–1192. Dec. 16. 1991. vol. 15/No. 497.

*Primary Examiner*—Timothy Thorpe
*Assistant Examiner*—Peter G. Korytnyk
*Attorney, Agent, or Firm*—Sughrue, Mion, Zinn, Macpeak & Seas, PLLC

[57] ABSTRACT

A swash plate type axial piston pump improved in respect to wear or abrasion-resistant capability of sliding members of the pump adapted to rotate relative to each other for protecting them from rapid wearing even upon high rotation of the pump. The axial piston pump includes a housing (1), a rotatable shaft (3) supported rotatably within the housing (1), an axial piston pump including a cylinder block (15) mounted on the shaft (3) axially slideably therealong and co-rotatably therewith and a plurality of pistons (21) accommodated axially reciprocatively within a corresponding number of cylinders, respectively, which extend axially, being arrayed around the rotatable shaft (3), a swash plate (23) disposed for moving reciprocatively the pistons (21) in axial direction as the shaft (3) is rotated, and a plurality of sliding members which are incorporated slideably relative to one another for constituting parts of the pump. At least one of the plural sliding members such as the valve plate (31), the cylinder block (15), the shoe (25), the swash plate (23), the shoe holder (27) and the supporting member (24) is coated with a nickel-phosphor-Teflon layer by plating.

11 Claims, 2 Drawing Sheets

SWASH PLATE TYPE AXIAL PISTON PUMP

BACKGROUND OF THE INVENTION

1. Field of the Invention

The present invention generally relates to a swash plate type axial piston pump (also known as the cam plate type axial piston pump or as the swash plate pump). More particularly, the invention is concerned with a swash plate type axial piston pump of a structure in which sliding contact surfaces between those members constituting parts of the pump which are caused to rotate relative to each other slidingly under a high pressure are improved in respect to wear-resistant capability and which thus can ensure an extended use life of the pump while allowing the pump to operate relatively silently without generating offensive noise.

2. Description of Related Art

For having better understanding of the invention, background techniques thereof will first be elucidated in some detail. FIG. 2 is a side elevational sectional view showing a conventional swash plate type axial piston pump known heretofore such as disclosed, for example, in Japanese Patent Application Publication No. 68472/1992. Referring to the figure, a rotatable shaft 103 is disposed within a housing 101 and rotatably supported at both ends by means of bearings constituted by a roller bearing 105 and a needle bearing 107, respectively, wherein one end of the rotatable shaft 103 is operatively coupled to a driving power source (not shown). Formed in the rotatable shaft 103 is a splined portion 113 onto which a cylinder block 111 having a plurality of cylinders 109 is mounted axially slideably and rotatably together with the rotatable shaft 103. The plural cylinders 109 of the cylinder block 111 are so formed as to be disposed around the rotatable shaft 103 with approximately equal angular distance between the adjacent cylinders 109, wherein pistons 115 are slideably accommodated within the individual cylinders 109, respectively, so as to be reciprocatively movable in the axial direction of the swash plate pump. An annular swash plate 117 is mounted on the rotatable shaft 103 with a play, wherein one ends of the pistons 115 are adapted to bear against an inner lateral surface of the swash plate 117 through interposed shoes 119, respectively. On the other hand, the other lateral side of the swash plate 117 is formed in a cylindrical configuration which is caused to abut against a cylindrical surface of a holder 121 mounted on the housing 101. Individual shoes 119 are held by an annular retainer 123 relative to the swash plate 117, wherein each of the shoes 119 has an approximately spherical portion 119*a* which is pivotally or swingably connected to one end of each piston 115. An outer peripheral portion of the swash plate 117 is coupled to a plunger 127 by means of an interconnecting arm 125 so that the swash plate 117 can variably be inclined relative to the center axis of the rotatable shaft 103 with a predetermined angular range of inclination.

Interposed between the bottom surface of the cylinder block 111 and the inner surface of the housing 101 is a valve plate 129 which is formed with an intake port 131 and an exhaust port 133. The cylinder block 111 is resiliently urged to the left, as viewed in FIG. 2, by means of a coil spring 135 mounted on and around the rotatable shaft 103, whereby the bottom of the cylinder block 111 is forced to bear against the inner surface of the housing 101 under the action of the coil spring 135 through the valve plate 129 interposed therebetween. Defined in each of the cylinders 109 of the cylinder block 111 is a pump chamber 110 which is selectively communicated to an intake passage 137 or a discharge passage 139 formed in the housing 101 by way of the intake port 131 or the discharge port 133 of the valve plate 129.

With the structure of the swash plate type axial piston pump described above, when the rotatable shaft 103 is driven rotationally by actuating the driving source (not shown) after having adjusted appropriately the angle of inclination of the swash plate 117 relative to the rotatable shaft 103 by operating the plunger 127, the cylinder block 111 is caused to rotate together with the rotatable shaft 103, whereby the pistons 115 accommodated within the respective cylinders 109 are caused to revolve together with the shaft 103. Because one ends of the pistons 115 bear against the swash plate 117 through the respective shoes 119, which plate 117 is inclined relative to the rotatable shaft 103, the pistons 115 are forced to move reciprocatively within the respective cylinders 109 in accompanying the rotation of the shaft 103. Thus, during the intake or suction stroke in which the piston 115 is moved to the right, as viewed in FIG. 2, a hydraulic medium such as oil is sucked into the pump chamber 110 formed in the cylinder 109 via the intake port 131 of the valve plate 129 through the intake passage 137, while during the discharge stroke in which the piston 115 is moved to the left as viewed in FIG. 2, the hydraulic oil confined within the pump chamber 110 is pressurized, as a result of which the oil is discharged to the discharge passage 139 formed in the housing 101 by way of the discharge port 133 of the valve plate 129.

In operation of the conventional swash plate type axial piston pump having the structure described above, there take place relative sliding rotations between paired metallic members such as a bottom of the cylinder block 111 and the valve plate 129, the shoes 119 and the retainer 123, the shoe 119 and the swash plate 117 and the like. These sliding members are lubricated by the oil resident within the bottom portion of the housing 101 and picked up by the cylinder block 111 during rotation thereof. In this conjunction, it is noted that in the conventional swash plate type axial piston pump, there has heretofore been made no proposal as to improvement of the wear- or abrasion-resistant capability of these slideable members.

Consequently, there often happens such situation that when the pump is operated at a high speed, lubrication of the sliding members becomes insufficient to such extent that the sliding surfaces of there metallic members are dried, incurring intensive abrasion or wear, which results in non-smooth pump operation, shortened use life of the pump, generation of offensive noise and other problems.

Further, when the swash plate type axial piston pump is employed as a pump for supplying fuel to injectors of a fuel injection type internal combustion engine, the fuel remaining within the pump upon stoppage thereof is apt to vaporize under heat of the engine. Thus, the engine is likely to be restarted from the dry state.

SUMMARY OF THE INVENTION

In the light of the state of the art described above, it is an object of the present invention to provide a swash plate type axial piston pump which is improved in respect to the wear or abrasion-resistant capability of the sliding members adapted to rotate relative to each other for protecting them from rapid wearing even upon high rotation of the pump, to thereby extend use life thereof.

Another object of the invention is to provide a swash plate type axial piston pump which can enjoy extended use life and silent operation without generation of offensive noise.

In view of the above and other objects which will become apparent as the description proceeds, there is provided according to a first aspect of the present invention a swash plate type axial piston pump which includes a housing, a rotatable shaft supported rotatably within the housing, an axial piston pump including a cylinder block mounted on the shaft axially slideably therealong and corotatably therewith and a plurality of pistons accommodated axially reciprocatively within a corresponding number of cylinders, respectively, which extend axially and is arrayed around the rotatable shaft, a swash plate disposed for moving reciprocatively the pistons in axial direction as the shaft is rotated, and a plurality of sliding members which are incorporated slideably relative to one another for constituting parts of the pump. At least one of the plural sliding members is coated with a nickel-phosphor-Teflon layer.

In a preferred mode for realizing the aspect of the invention mentioned above, at least one pair of mutually sliding members in a plurality of pairs of mutually sliding members may be coated with a nickel-phosphor-Teflon layer by plating.

According to a second aspect of the invention, there is provided a swash plate type axial piston pump which includes a housing, a rotatable shaft disposed within the housing and supported rotatably within the housing by means of bearings at both ends thereof, respectively, and driven rotationally by a driving source, a swash plate fixedly secured to the housing in a state inclined relatively to the center axis of the rotatable shaft by means of an annular supporting member, a cylinder block disposed within the housing and mounted on the rotatable shaft slideably in an axial direction thereof and corotatably therewith, the cylinder block having a plurality of cylinders each defining therein a pump chamber, a plurality of pistons having one end portions slideably fit in the cylinders, respectively, a plurality of shoes have one ends coupled swingably to the pistons, respectively, and the other ends placed in slideable contact with one lateral surface of the swash plate, an annular shoe holder having a plurality of retaining holes and an outer peripheral portion slideably contacting the supporting member, a valve plate disposed such that one lateral surface thereof bears on the inner surface of the housing with the other lateral surface thereof bearing on a bottom surface of the cylinder block, the rotatable shaft extending through the valve plate, and an intake passage and an exhaust passage formed in the housing are selectively communicated to the pump chambers defined by the cylinders, respectively. In the swash plate type axial piston pump described above, it is taught according to the invention that at least one of plural sliding members contacting slideably with one another is coated with a nickel-phosphor-Teflon layer.

In another preferred mode for realizing the second aspect of the invention mentioned above, the aforementioned one sliding member may be the valve plate, the cylinder block, the shoe, the swash plate, the shoe holder or the supporting member.

In yet another preferred mode for carrying out the invention, heat treatment should be performed on the valve plate after application of the nickel-phosphor-Teflon coating thereon.

According to a third aspect of the invention, there is provided a swash plate type axial piston pump which includes a housing, wherein a rotatable shaft is disposed within the housing and supported rotatably within the housing by means of bearings at both ends thereof, respectively, and can be driven rotationally by a driving source, a swash plate fixedly secured to the housing in a state in which the swash is inclined relatively to the center axis of the rotatable shaft by means of an annular supporting member, and a cylinder block disposed within the housing and mounted on the rotatable shaft slideably in an axial direction thereof and corotatably therewith, the cylinder block having a plurality of cylinders each defining therein a pump chamber, a plurality of pistons having one end portions slideably fit in the cylinders, respectively, a plurality of shoes having one ends coupled swingably to the pistons, respectively, and the other ends placed in slideable contact with one lateral surface of the swash plate, an annular shoe holder having a plurality of retaining holes and an outer peripheral portion slideably contacting the supporting member, and a valve plate disposed such that one lateral surface thereof bears on the inner surface of the housing with the other lateral surface thereof bearing on a bottom surface of the cylinder block. The rotatable shaft extends through the valve plate, wherein an intake passage and an exhaust passage formed in the housing are selectively communicated to the pump chambers defined by the cylinders, respectively. According to the invention, at least one pair of mutually sliding members of plural pairs of mutually sliding members are each coated with a nickel-phosphor-Teflon layer by plating.

The plural pairs of the sliding members may include a pair of the valve plate and the cylinder block, a pair of the shoes and the swash plate, and a pair of the shoe holder and the supporting member.

Preferably, the valve plate, the shoe and the supporting member may be each coated with a nickel-phosphor-Teflon layer.

Further preferably, the valve plate should be made of a ferrous material, while the cylinder block should be made of spherulitic graphite cast iron.

Additionally, the shoe should preferably be made of special-purpose high-tensile brass, while the swash plate should preferably be made of steel undergone a nitriding treatment.

Moreover, the supporting member should preferably be made of a ferrous material, while the shoe holder should preferably further be formed of quenched steel.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
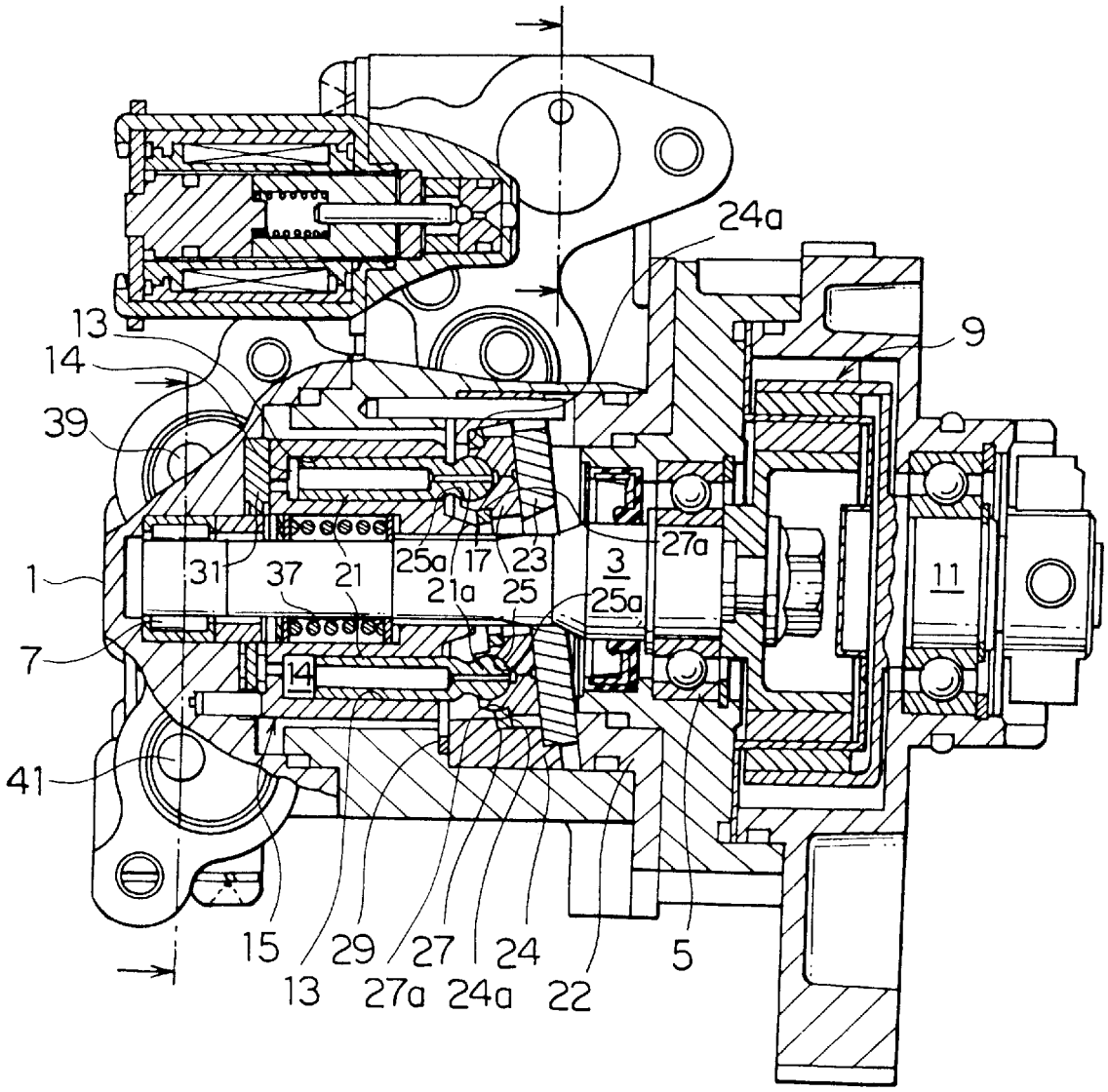
FIG. 1 is a vertical sectional view showing a swash plate type axial piston pump according to a first embodiment of the present invention.
Figure 2:
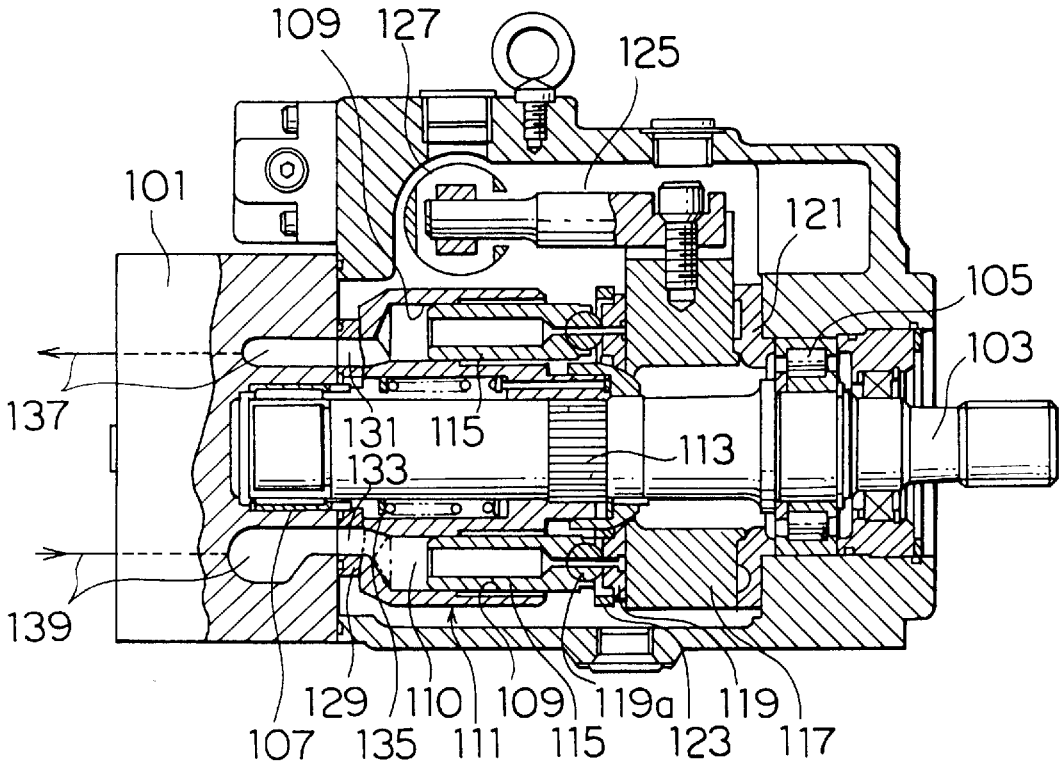
FIG. 2 PRIOR ART
FIG. 2 is a sectional side view showing a conventional swash plate type axial piston pump known heretofore.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", and the like are words of convenience and are not to be construed as limiting terms.

Embodiment 1

FIG. 1 is a vertical sectional view showing a swash plate type axial piston pump according to an exemplary embodiment of the invention.

Referring to the figure, accommodated within the housing 1 is a rotatable shaft 3 which is rotatably supported in the housing 1 by a ball bearing 5 or the like at one end portion and a needle bearing 7 or the like at the other end, wherein the other end of the rotatable shaft 3 is operatively coupled to the input shaft 11 by means of a magnetic coupling 9. On the other hand, the input shaft 11 is operatively coupled to a driving source such as an internal combustion engine or the like (not shown).

The rotatable shaft 3 has a splined shaft portion 17 formed therein, wherein a cylinder block 15 having a plurality of cylinders 13 formed in a coaxial circular array is fit onto the splined shaft portion 17 slideably in the axial direction and co-rotatably with the shaft 3. The cylinders 13 formed in the cylinder block 15 are disposed around the rotatable shaft 3 with substantially equidistance therebetween, wherein a piston 21 is disposed within each of the cylinders 13 reciprocatively in the axial direction.

Further, a ring-like or annular swash plate 23 is mounted on the rotatable shaft 3 with a small range of motion, wherein the swash plate 23 is fixedly held by the housing 1 along the outer peripheral portion in a state inclined or slanted relative to the center axis of the rotatable shaft 3. More specifically, the outer peripheral portion of the swash plate 23 is fixedly held, being sandwiched between the annular supporting member 24 and an annular insulator 22 which is secured fixedly at a flange portion to the housing 1 and formed of a heat insulation material.

The pistons 21 are adapted to bear on an inner or left lateral surface of the swash plate 23 at one or right ends thereof by way of shoes 25, respectively. More specifically, an approximately semispherical head 21*a* formed at one end of each of the pistons 21 is rotatably fit into a complementary semispherical recess 25*a* formed in the corresponding shoe 25, whereby each piston 21 is swingably or pivotally coupled to the associated shoe 25. A portion of each shoe 25 is held slideably in contact with the one or inner lateral surface of the swash plate 23 through cooperation of an annular shoe holder 27 and the annular or ring-like supporting member 24. The annular shoe holder 27 is formed with a number of retaining holes 27*a* corresponding to that of the shoes 25, respectively, wherein the shoes 25 are fit into the retaining holes 27*a,* respectively, while the outer peripheral portion of the shoe holder 27 bears against an offset portion 24*a* formed in the inner peripheral surface of the annular supporting member 24. Thus, when the pistons 21 are revolved together with the cylinder block 15 as the shaft 3 is rotated, the shoes 25 and the shoe holders 27 are caused to rotate about the center axis of the rotatable shaft 3 together with the cylinder block 15, whereby the end surfaces of the individual shoes 25 are caused to move slideably relative to the swash plate 23 in the state contacting the latter, while the annular shoe holder 27 is caused to move slideably relative to the offset portion 24*a* of the annular supporting member 24.

Furthermore, the annular supporting member 24 is resiliently urged to the right, as viewed in FIG. 1, by a wave washer 29, as a result of which the other end of the annular supporting member 24 is pressed against the swash plate 23 by the wave washer 29 which bears against the other surface of the supporting member 24, while the shoes 25 are resiliently pressed onto the swash plate 23 through the annular supporting member 24 and the shoe holder 27.

Interposed between the bottom side of the cylinder block 15 and the inner surface of the housing 1 is a valve plate 31. An intake port and a discharge port, each of an arcuate shape (not shown), are formed in the valve plate 31. The cylinder block 15 is resiliently urged to the left, as viewed in FIG. 1, by a coil spring 37 mounted around the outer peripheral surface of the rotatable shaft 3, whereby the bottom of the cylinder block 15 is resiliently pressed against the inner surface of the housing 1 by way of the interposed valve plate 31. The pump chambers 14 defined within the cylinders 13, respectively, of the cylinder block 15 are selectively interconnected to the intake passage 39 or the discharge passage 41 formed within the housing 1 by way of the intake port or the discharge port of the valve plate, accompanying the rotation of the cylinder block 15 following the rotation of the rotatable shaft 3.

Now, description will be made of operation of the swash plate type axial piston pump according to the instant embodiment of the invention.

When the rotatable shaft 3 is driven rotationally by the driving source (not shown) by way of the input shaft 11 and the magnetic coupling 9, the cylinder block 15 is caused to rotate together with the rotatable shaft 3, whereby the pistons 21 accommodated within the respective cylinders 13 are caused to revolve together with the cylinder block 15. Because one ends of the pistons 21 bear against the swash plate 23 through the respective shoes 25, which plate 23 is fixedly supported to the housing 1 in the state inclined relative to the center axis of the rotatable shaft 3, the pistons 21 are forced to move reciprocatively in the axial direction within the cylinders 13 in accompanying the rotation of the shaft 3. Thus, during the intake or suction stroke in which the piston 21 is moved to the right, as viewed in FIG. 1, the pump chamber 14 defined within the cylinder 13 is communicated to the intake port (not shown) of the valve palate 31, a fluid such as oil is sucked into the pump chamber 14 formed in the cylinder 13 via the intake port (not shown) of the valve plate 31 from the intake passage 39 formed in the housing 1. On the other hand, during the discharge stroke in which the piston 21 is moved to the left, as viewed in FIG. 1, the pump chamber 14 is communicated to the discharge port (not shown) of the valve plate 31, wherein oil confined within the pump chamber 14 is pressurized, as a result of which the oil is discharged to the discharge passage 41 formed in the housing 1 by way of the discharge port (not shown either) of the valve plate 31.

According to the teachings of the present invention incarnated in the instant embodiment, at least one of the sliding members (e.g. at least one of the valve plate 31 and the cylinder block 15, at least one of the shoe 25 and the swash plate 23 or at least one of the annular shoe holder 27 and the annular supporting member 24) which are brought into sliding engagement with each other during operation of the swash plate type axial piston pump is coated or plated with a nickel-phosphor-Teflon layer (Ni-P-PTFE) (commercially available under the trade name "NEDOX" or "KANIFLON"), as a surface treatment for enhancing the durability of the above-mentioned member and hence that of the axial piston pump as a whole.

By way of the example, the sliding members may be made of materials enumerated below.

| MEMBERS | MATERIALS |
|---|---|
| VALVE PLATE | FERROUS MATERIAL SUCH AS CARBON STEEL COMMERCIALLY AVAILABLE AS "S45C" OR THE LIKE |
| CYLINDER BLOCK | SPHERULITIC GRAPHITE CAST IRON COMMERCIALLY AVAILABLE AS "FCD" |
| SHOE HOLDER | FERROUS MATERIAL SUCH AS CHROMIUM-MOLYBDENUM STEEL AVAILABLE AS "SCM435" OR THE LIKE |
| SHOE | SPECIAL-PURPOSE HIGH-TENSILE BRASS AVAILABLE AS "HB-71 (½H)" OR THE LIKE |
| SUPPORTING MEMBER | FERROUS MATERIAL SUCH AS FREE CUTTING STEEL AVAILABLE AS "SUM23L" OR THE LIKE |
| SWASH PLATE | FERROUS MATERIAL SUCH AS CHROMIUM-MOLYBDENUM STEEL "SCM435" OR THE LIKE |

When the valve plate 31 is plated with nickel-phosphor-Teflon, it is preferred to perform heat treatment on the plated valve plate at 400° C. about one hour after plating in order to enhance the hardness or mechanical strength of the coating. Furthermore, the shoe holder 27 should preferably be subjected to a quenching treatment with the supporting member 24 undergone a salt-bath nitriding treatment. In addition, the swash plate 23 should be subjected to a nitriding treatment such as treatment in the presence of a nitriding gas. Besides, for plating the swash plate 23 with nickel-phosphor-Teflon, the swash plate 23 should preferably be made of carbon steel such as "S45C" or the like.

High-temperature high-speed durability test of the swash plate type axial piston pump has experimentally been conducted over 500 hours on the conditions mentioned hereinafter for the shoes 25, the supporting member 24 and the valve plate 31 plated with the nickel-phosphor-Teflon coating in comparison with those not coated. Results are listed in the following table 1.

Conditions for durability test are as follows:

Thickness of plated coats (desired values): for shoe . . . 10 μm, for supporting member . . . 15 μm, and for valve plate . . . 10 μm, and type of oil: gasoline, rotation speed (rpm) of the rotatable shaft: 4000 rpm, and hydraulic pressure of oil: 7 MPa.

As can be seen from the above table, the members plated are significantly improved in respect to the abrasion-resistant capability by a factor of about "3" to "500" and about "10" on an average.

Parenthetically, it is preferred that when the valve plate 31, the shoe 25 and the supporting member 24 are coated with nickel-phosphor-Teflon, respectively, the shoe holder 27 is formed of spherulitic graphite cast iron (FCD) with the cylinder block 15 being formed of quenched steel while the swash plate 23 is formed of steel undergone nitriding treatment.

From the standpoint of improvement of the abrasion withstanding capability, it is preferred to apply all the sliding members of the swash plate type axial piston pump with the nickel-phosphor-Teflon coat. However, from the economical viewpoint, the coating mentioned above may be applied to only one of the sliding members (e.g. only the valve plate 31). Of course, from the standpoint of enhanced abrasion withstanding capability and the economical viewpoint, only counterparts of all the pairs of the sliding members (e.g. the valve plate 31, the shoe 25 and the supporting member 24) may be coated by plating.

As is apparent from the foregoing, in the swash plate type axial piston pump according to the invention, by applying the nickel-phosphor-Teflon plating to at least one of the relatively sliding members (e.g. the valve plate 31, the cylinder block 15, the shoe 25, the swash plate 23, the shoe holder 27, and the supporting member 24 and other), abrasion of the sliding members can be suppressed to a minimum, which is in turn effective for suppressing generation of offensive or uncomfortable noise, while the use life of the swash plate type axial piston pump as a whole can be extended.

Further, by coating at least one pair of the mutually sliding members (such as the pair of the valve plate 31 and the cylinder block 15, the pair of the shoe 25 and the swash plate 23, and the pair of the shoe holder 27 and the supporting member 24) with a nickel-phosphor-Teflon layer, the sliding

TABLE 1

ABRASION COMPARISON DATA FOR PARTS WITH/WITHOUT SURFACE TREATMENT

UNIT: μm

| | | ABRASIONS OF MEMBERS OF CONCERN (MAX.) | | | | | | | |
|---|---|---|---|---|---|---|---|---|---|
| | | SHOES | | SWASH | SUPPORTING | SHOE HOLDER | | VALVE PLATE | CYLINDER BLOCK |
| PLATED OR NOT | DURABILITY IN HOUR | SURFACE FACING SWASH PLATE | SURFACE FACING SHOE HOLDER | PLATE SURFACE FACING SHOES | MEMBER SURFACE FACING SHOES | SURFACE FACING SUPPORTING MEMBER | SURFACE FACING SHOES | SURFACE FACING CYLINDER | SURFACE FACING VALVE PLATE |
| NOT PLATED | 500 | 1.37 | 25.4 | 7.5 | 10.0 | 5.0 | 17.0 | 14.5* | 100.0* |
| PLATED | 500 | 0.30 | 4.0 | SMALLER THAN 0.1 | SMALLER THAN 1.0 | SMALLER THAN 0.5 | 5.0 | 1.51 | 0.2 |

Notes:
Mark * represents the life time shorter than 130 hours. Plating is performed on the shoes, the supporting member and the valve plate. Measured values of the abrasion are given in terms of Rmax values.

abrasion or wear of these members can further be reduced with the relative sliding movements of these members being improved. Besides, generation of offensive noise can be suppressed to a minimum with the use life of the sliding member being elongated to maximum.

Many modifications and variations of the present invention are possible in the light of the above techniques. It is therefore to be understood that within the scope of the appended claims, the invention may be practiced otherwise than as specifically described.

What is claimed is:

1. A swash plate type axial piston pump, comprising:

a housing;

a rotatable shaft supported rotatably within said housing;

an axial piston pump including a cylinder block mounted on said shaft axially slideably therealong and co-rotatably therewith and a plurality of pistons accommodated axially reciprocatively within a corresponding number of cylinders, respectively, which extend axially, being arrayed around said rotatable shaft;

a swash plate disposed for moving reciprocatively said pistons in axial direction as said shaft is rotated; and a plurality of sliding members which are incorporated slideably relative to one another for constituting parts of said pump, wherein at least one of said plural sliding members is coated with a nickel-phosphor-Teflon layer.

2. A swash plate type axial piston pump according to claim 1, wherein at least one pair of mutually sliding members in a plurality of pairs of mutually sliding members is coated with a nickel-phosphor-Teflon layer by plating.

3. A swash plate type axial piston pump, comprising:

a housing;

a rotatable shaft disposed within said housing and supported rotatably within said housing by means of bearings at both ends thereof, respectively, and which can be driven rotationally by a driving source;

a swash plate fixedly secured to said housing in a state inclined relatively to the center axis of said rotatable shaft by means of an annular supporting member;

a cylinder block disposed within said housing and mounted on said rotatable shaft slideably in an axial direction thereof and co-rotatably therewith, said cylinder block having a plurality of cylinders each defining therein a pump chamber;

a plurality of pistons having one end portions slideably fit in said cylinders, respectively;

a plurality of shoes having one end coupled swingably to said pistons, respectively, and other ends placed in slideable contact with one lateral surface of said swash plate;

an annular shoe holder having a plurality of retaining holes and an outer peripheral portion slideably contacting said supporting member; and a valve plate disposed such that one lateral surface thereof bears on the inner surface of said housing with other lateral surface thereof bearing on a bottom surface of said cylinder block, said rotatable shaft extending through said valve plate, wherein an intake passage and an exhaust passage formed in said housing are selectively communicated to the pump chambers defined by said cylinders, respectively, wherein at least one of plural sliding members contacting slideably with one another is coated with a nickel-phosphor-Teflon layer.

4. A swash plate type axial piston pump according to claim 3, wherein at least one of said sliding members is one of said valve plate, said cylinder block, said shoe, said swash plate, said shoe holder and said supporting member.

5. A swash plate type axial piston pump according to claim 4, wherein heat treatment is performed on said valve plate after application of said nickel-phosphor-Teflon coating thereon.

6. A swash plate type axial piston pump, comprising:

a housing;

a rotatable shaft disposed within said housing and supported rotatably within said housing by means of bearings at both ends thereof, respectively, and which can be driven rotationally by a driving source;

a swash plate fixedly secured to said housing in a state inclined relatively to the center axis of said rotatable shaft by means of an annular supporting member;

a cylinder block disposed within said housing and mounted on said rotatable shaft slideably in an axial direction thereof and co-rotatably therewith, said cylinder block having a plurality of cylinders each defining therein a pump chamber;

a plurality of pistons having one end portions slideably fit in said cylinders, respectively;

a plurality of shoes having one end coupled swingably to said pistons, respectively, and other ends placed in slideable contact with one lateral surface of said swash plate;

an annular shoe holder having a plurality of retaining holes and an outer peripheral portion slideably contacting said supporting member; and a valve plate disposed such that one lateral surface thereof bears on the inner surface of said housing with other lateral surface thereof bearing on a bottom surface of said cylinder block, said rotatable shaft extending through said valve plate, wherein an intake passage and an exhaust passage formed in said housing are selectively communicated to the pump chambers defined by said cylinders, respectively, wherein at least one pair of mutually sliding members of plural pairs of mutually sliding members are each coated with a nickel-phosphor-Teflon layer by plating.

7. A swash plate type axial piston pump according to claim 6, wherein said plural pairs of said sliding members include a pair of said valve plate and said cylinder block, a pair of said shoes and said swash plate, and a pair of said shoe holder and said supporting member.

8. A swash plate type axial piston pump according to claim 7, wherein said valve plate, said shoe and said supporting member are each coated with a nickel-phosphor-Teflon layer.

9. A swash plate type axial piston pump according to claim 8, wherein said valve plate is made of a ferrous material, and wherein said cylinder block is made of spherulitic graphite cast iron.

10. A swash plate type axial piston pump according to claim 8, wherein said shoe is made of special-purpose high-tensile brass, and wherein said swash plate is made of steel undergone a nitriding treatment.

11. A swash plate type axial piston pump according to claim 8, wherein said supporting member is made of a ferrous material, and wherein said shoe holder is formed of quenched steel.

* * * * *